US008012270B2

(12) United States Patent
Pieper et al.

(10) Patent No.: US 8,012,270 B2
(45) Date of Patent: Sep. 6, 2011

(54) SOFT MAGNETIC IRON/COBALT/CHROMIUM-BASED ALLOY AND PROCESS FOR MANUFACTURING IT

(75) Inventors: Witold Pieper, Gelnhausen (DE); Joachim Gerster, Alzenau (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 407 days.

(21) Appl. No.: 12/219,615

(22) Filed: Jul. 24, 2008

(65) Prior Publication Data

US 2009/0184790 A1 Jul. 23, 2009

Related U.S. Application Data

(60) Provisional application No. 60/935,146, filed on Jul. 27, 2007.

(51) Int. Cl.
*H01F 1/147* (2006.01)

(52) U.S. Cl. ..... 148/315; 148/311; 148/120; 148/121

(58) Field of Classification Search ..... None
See application file for complete search history.

(56) References Cited

U.S. PATENT DOCUMENTS

| | | | |
|---|---|---|---|
| 2,225,730 | A | 12/1940 | Armstrong |
| 2,926,008 | A | 2/1960 | Barnett et al. |
| 2,960,744 | A | 11/1960 | Blank |
| 3,255,512 | A | 6/1966 | Lochner et al. |
| 3,337,373 | A | 8/1967 | Foster et al. |
| 3,401,035 | A | 9/1968 | Moskowitz et al. |
| 3,502,462 | A | 3/1970 | Dabkowski et al. |
| 3,624,568 | A | 11/1971 | Olsen et al. |
| 3,634,072 | A | 1/1972 | Ackemann et al. |
| 3,977,919 | A | 8/1976 | Foster et al. |
| 4,059,462 | A | 11/1977 | Masumoto et al. |
| 4,076,525 | A | 2/1978 | Little et al. |
| 4,076,861 | A | 2/1978 | Furukawa et al. |
| 4,120,704 | A | 10/1978 | Anderson |
| 4,160,066 | A | 7/1979 | Szumachowski et al. |
| 4,201,837 | A | 5/1980 | Lupinski |
| 4,601,765 | A | 7/1986 | Soileau et al. |
| 4,891,079 | A | 1/1990 | Nakajima et al. |

(Continued)

FOREIGN PATENT DOCUMENTS

| | | |
|---|---|---|
| CH | 668331 | 12/1988 |

(Continued)

OTHER PUBLICATIONS

Major and Orrock, "High Saturation Ternary Cobalt-Iron Based Alloys," IEEE Transactions on Magnetics, vol. 24, No. 2, Mar. 1988, pp. 1856-1858.

(Continued)

*Primary Examiner* — John P Sheehan
(74) *Attorney, Agent, or Firm* — Buchanan, Ingersoll & Rooney P.C.

(57) ABSTRACT

A soft magnetic alloy consists essentially of 5 percent by weight≦Co≦30 percent by weight, 1 percent by weight≦Cr≦20 percent by weight, 0.1 percent by weight≦Al≦2 percent by weight, 0 percent by weight≦Si≦1.5 percent by weight, 0.017 percent by weight≦Mn≦0.2 percent by weight, 0.01 percent by weight≦S≦0.05 percent by weight where Mn/S is >1.7, 0 percent by weight≦O≦0.0015 percent by weight, und 0.0003 percent by weight≦Ce≦0.05 percent by weight, 0 percent by weight≦Ca≦0.005 percent by weight and the remainder iron, where 0.117 percent by weight≦(Al+Si+Mn+V+Mo+W+Nb+Ti+Ni)≦5 percent by weight.

27 Claims, 2 Drawing Sheets

U.S. PATENT DOCUMENTS

| | | | | |
|---|---|---|---|---|
| 4,923,533 | A | | 5/1990 | Shigeta et al. |
| 4,950,550 | A | | 8/1990 | Radeloff et al. |
| 4,969,963 | A | | 11/1990 | Honkura et al. |
| 4,994,122 | A | | 2/1991 | DeBold et al. |
| 5,069,731 | A | | 12/1991 | Yoshizawa et al. |
| 5,091,024 | A | | 2/1992 | DeBold et al. |
| 5,200,002 | A | | 4/1993 | Hilzinger |
| 5,202,088 | A | | 4/1993 | Genma et al. |
| 5,261,152 | A | | 11/1993 | Simozaki et al. |
| 5,268,044 | A | | 12/1993 | Hemphill et al. |
| 5,501,747 | A | | 3/1996 | Masteller et al. |
| 5,522,946 | A | | 6/1996 | Tomita et al. |
| 5,534,081 | A | | 7/1996 | Takagi et al. |
| 5,594,397 | A | | 1/1997 | Uchikoba et al. |
| 5,611,871 | A | | 3/1997 | Yoshizawa et al. |
| 5,703,559 | A | | 12/1997 | Emmerich et al. |
| 5,714,017 | A | | 2/1998 | Tomida et al. |
| 5,725,686 | A | | 3/1998 | Yoshizawa et al. |
| 5,741,374 | A | | 4/1998 | Li |
| 5,769,974 | A | | 6/1998 | Masteller et al. |
| 5,783,145 | A | * | 7/1998 | Coutu et al. ..... 420/94 |
| 5,804,282 | A | | 9/1998 | Watanabe et al. |
| 5,817,191 | A | | 10/1998 | Emmerich et al. |
| 5,911,840 | A | | 6/1999 | Couderchon et al. |
| 5,914,088 | A | | 6/1999 | Rao et al. |
| 5,922,143 | A | | 7/1999 | Verin et al. |
| 5,976,274 | A | | 11/1999 | Inoue et al. |
| 6,001,272 | A | | 12/1999 | Ikuma et al. |
| 6,106,376 | A | | 8/2000 | Rybak et al. |
| 6,118,365 | A | | 9/2000 | Petzold et al. |
| 6,171,408 | B1 | | 1/2001 | Herzer et al. |
| 6,181,509 | B1 | | 1/2001 | Canlas et al. |
| 6,270,592 | B1 | | 8/2001 | Nakajima et al. |
| 6,373,368 | B1 | | 4/2002 | Shikama et al. |
| 6,462,456 | B1 | | 10/2002 | DeCristofaro et al. |
| 6,507,262 | B1 | | 1/2003 | Otte et al. |
| 6,563,411 | B1 | | 5/2003 | Otte et al. |
| 6,588,093 | B1 | | 7/2003 | Emmerich et al. |
| 6,616,125 | B2 | | 9/2003 | Brown et al. |
| 6,685,882 | B2 | | 2/2004 | Deevi et al. |
| 6,710,692 | B2 | | 3/2004 | Kato et al. |
| 6,749,767 | B2 | | 6/2004 | Mitani et al. |
| 6,942,741 | B2 | | 9/2005 | Shimao et al. |
| 6,946,097 | B2 | | 9/2005 | Deevi et al. |
| 6,962,144 | B2 | | 11/2005 | Chretien et al. |
| 7,128,790 | B2 | | 10/2006 | Waeckerle et al. |
| 7,442,263 | B2 | | 10/2008 | Günther et al. |
| 7,532,099 | B2 | | 5/2009 | Brunner |
| 7,563,331 | B2 | | 7/2009 | Petzold et al. |
| 2001/0015239 | A1 | | 8/2001 | Kanekiyo |
| 2001/0031837 | A1 | | 10/2001 | Perez et al. |
| 2002/0062885 | A1 | | 5/2002 | Li |
| 2002/0158540 | A1 | | 10/2002 | Lindquist et al. |
| 2003/0034091 | A1 | | 2/2003 | Shimao et al. |
| 2004/0027220 | A1 | | 2/2004 | Günther et al. |
| 2004/0089377 | A1 | | 5/2004 | Deevi et al. |
| 2004/0099347 | A1 | | 5/2004 | Waeckerle et al. |
| 2004/0112468 | A1 | | 6/2004 | Petzold et al. |
| 2004/0183643 | A1 | | 9/2004 | Brunner |
| 2005/0017587 | A1 | | 1/2005 | Koenig |
| 2005/0268994 | A1 | | 12/2005 | Gerster et al. |
| 2007/0176025 | A1 | | 8/2007 | Gerster |
| 2008/0042505 | A1 | | 2/2008 | Gerster et al. |
| 2008/0099106 | A1 | | 5/2008 | Pieper et al. |
| 2008/0136570 | A1 | | 6/2008 | Gester |
| 2009/0039994 | A1 | | 2/2009 | Pieper et al. |
| 2009/0145522 | A9 | | 6/2009 | Pieper et al. |
| 2009/0206975 | A1 | | 8/2009 | Nuetzel et al. |
| 2010/0018610 | A1 | | 1/2010 | Petzold et al. |

FOREIGN PATENT DOCUMENTS

| | | | |
|---|---|---|---|
| CN | 1185012 | A | 6/1998 |
| DE | 694374 | | 7/1940 |
| DE | 2816173 | | 10/1979 |
| DE | 3324729 | | 1/1984 |
| DE | 3237183 | | 4/1984 |
| DE | 3427716 | | 11/1985 |
| DE | 3542257 | | 6/1987 |
| DE | 4030791 | A1 | 8/1991 |
| DE | 4442420 | A1 | 5/1996 |
| DE | 4444482 | A1 | 6/1996 |
| DE | 69714103 | T2 | 9/1997 |
| DE | 19635257 | | 3/1998 |
| DE | 19844132 | | 4/1999 |
| DE | 19818198 | | 10/1999 |
| DE | 19908374 | A1 | 9/2000 |
| DE | 19928764 | A1 | 1/2001 |
| DE | 69611610 | | 7/2001 |
| DE | 10024824 | | 11/2001 |
| DE | 10031923 | A1 | 1/2002 |
| DE | 69903202 | | 6/2003 |
| DE | 10211511 | | 10/2003 |
| DE | 10320350 | | 9/2004 |
| DE | 103 48 808 | B4 | 3/2005 |
| DE | 103 48 810 | A1 | 3/2005 |
| DE | 602 05 728 | T2 | 3/2006 |
| EP | 0216457 | A1 | 4/1987 |
| EP | 0299498 | | 1/1989 |
| EP | 0429022 | | 5/1991 |
| EP | 0271657 | | 5/1992 |
| EP | 0635853 | | 1/1995 |
| EP | 0637038 | | 2/1995 |
| EP | 0435680 | B1 | 4/1995 |
| EP | 0715320 | A1 | 6/1996 |
| EP | 0794541 | A1 | 9/1997 |
| EP | 0804796 | A1 | 11/1997 |
| EP | 0824755 | B1 | 2/1998 |
| EP | 1124999 | A1 | 8/2001 |
| EP | 1 371 434 | B1 | 12/2003 |
| EP | 1475450 | A1 | 11/2004 |
| EP | 1503486 | | 2/2005 |
| GB | 833446 | | 4/1960 |
| GB | 1369844 | | 10/1974 |
| JP | 51092097 | A | 2/1975 |
| JP | 54006808 | A | 6/1977 |
| JP | 59058813 | A | 4/1984 |
| JP | 59177902 | | 10/1984 |
| JP | 61058450 | | 3/1986 |
| JP | 61253348 | A | 11/1986 |
| JP | 6293342 | A | 4/1987 |
| JP | 62093342 | A | 4/1987 |
| JP | 63-21807 | | 1/1988 |
| JP | 1247557 | A | 3/1989 |
| JP | 02301544 | | 12/1990 |
| JP | 03-019307 | | 1/1991 |
| JP | 03-146615 | | 6/1991 |
| JP | 4-048005 | A | 2/1992 |
| JP | 05283238 | | 10/1993 |
| JP | 05-299232 | | 11/1993 |
| JP | 6033199 | A | 2/1994 |
| JP | 06-224023 | | 8/1994 |
| JP | 08-246109 | | 9/1996 |
| JP | 10-092623 | | 4/1998 |
| JP | 10-097913 | | 4/1998 |
| JP | 2000-182845 | | 6/2000 |
| JP | 2000-277357 | A | 10/2000 |
| JP | 2001-068324 | | 3/2001 |
| JP | 2002294408 | A | 3/2001 |
| JP | 2004-349585 | | 12/2004 |
| JP | 2006193779 | A | 7/2006 |
| JP | 2006322057 | A | 11/2006 |
| JP | 2007113148 | | 5/2007 |
| SU | 338550 | | 5/1972 |
| SU | 1062298 | A1 | 7/1982 |
| WO | WO 96/19001 | | 6/1996 |
| WO | WO 00/25326 | | 5/2000 |
| WO | WO 0100895 | A1 | 1/2001 |
| WO | WO 01/86665 | A1 | 11/2001 |
| WO | WO 02/055749 | | 7/2002 |
| WO | WO 03/003385 | | 1/2003 |
| WO | WO 2007/088513 | | 8/2007 |

OTHER PUBLICATIONS

H. Reinboth, "Technologie and Anwendung magnetischer Werkstoffe," Veb Verlag Technik, p. 230 (1969).

A. Taub, "Effect of the heating rate used during stress relief annealing on the magnetic properties of amorphous alloys," J. Appl. Phys. 55, No. 6, Mar. 15, 1984, pp. 1775-1777.
Abstract of Japanese Patent Publication No. 2000277357, Oct. 6, 2000.
Abstract of Japanese Patent Publication No. 59058813, Apr. 4, 1984.
Liu Junxin et Yuqin Qiu: "Heat Treating Method of Nanocrystalline Current Transformer Core".
First Office Action mailed Jan. 7, 2005 issued by the Chinese Patent Office for Chinese Patent Application No. 02809188.4.
Second Office Action mailed Jul. 8, 2005 issued by the Chinese Patent Office for Chinese Patent Application No. 02809188.4.
J. Wünning: "Die Wärmebehandlung in der Fertigungslinie mit einem neuartigen Rollenherdofen," HTM Härterei—Technische Mitteilungen 45 (1990) Nov./Dec., No. 6, pp. 325-329 XP 163038.
Examination Report dated Sep. 24, 2009 for European Publication No. 02 745 429.7-2208.
Liu Junxin et Yuqin Qiu: "Heat Treating Method of Nanocrystalline Current Transformer Core" (English Translation and Certificate of Translation dated Nov. 23, 2009).
H. Reinboth, "Technologie und Anwendung magnetischer Werkstoffe," Veb Verlag Technik, p. 230 (1969) (English Translation and Certificate of Translation dated Nov. 23, 2009).
Examination Report dated Feb. 26, 2003 for German Patent Publication No. 101 34 056.7-33 (English Translation and Certificate of Translation dated Nov. 23, 2009).
German Patent Publication No. 694374 (English Translation and Certificate of Translation dated Nov. 23, 2009).
Chinese Patent Publication No. CN1185012A (English Translation and Certificate of Translation dated Nov. 23, 2009).
Non-Final Office Action dated Jun. 11, 2009 for U.S. Appl. No. 11/663,271.
Non-Final Office Action dated Sep. 22, 2009 for U.S. Appl. No. 11/663,271.
Final Office Action dated Oct. 30, 2009 for U.S. Appl. No. 11/343,558.
Böhler N114 Extra; Nichtrostender Weichmagnetischer Stahl Stainless Soft Magnetic Steel; Böhler Edelstahl GMBH & Co KG; N244 DE EM-WS; 11 pgs.
Carpenter Specialty Alloys; Alloy Data, Chrome Core 8 & 8-FM Alloys and Chrome Core 12 & 12-FM Alloys; Carpenter Technology Corporation; Electronic Alloys; 12 pgs.
Sundar, R.S. et al.; Soft Magnetic FeCo alloys; alloy development, processing, and properties; International Materials Reviews, vol. 50, No. 3, pp. 157-192.
Stahlschlüssel 1958. Marbach: Verlag Stahlschlüssel Wegst GmbH, 1998, Version 2.0, ISBN 3-922599-15-X, Window "Analyse-Suche".
Yoshizawa, Y. et al.; Magnetic Properties of High $B_2$ Nanocrystalline FeCoCuNbSiB Alloys, Advanced Electronics Research Lab, Hitachi Metals, Ltd., 5200 Mikajiri Kumagaya, Japan, 0-7803-9009-1/05/ $20.00 © 2005 IEEE, BR 04.
Non-Final Office Action dated Sep. 29, 2008 for U.S. Appl. No. 11/343,558.
Non-Final Office Action dated Apr. 6, 2009 for U.S. Appl. No. 11/343,558.
Examination Report dated Feb. 26, 2003 for German Patent Publication No. 101 34 056.7-33 (English Translation and Certificate of Translation dated Nov. 23, 2009).
E. Wolfarth: "Ferromagnetic Materials vol. 2,"—Soft Magnetic Metallic Materials—p. 73 (1980).
ASM Materials Engineering Dictionary, Edited by J.R. Davis, Davis & Associates, 1992, p. 2002.
R. McCurrie, "Ferromagnetic Materials Structure and Properties," Academic Press, pp. 77-78 (1994).
Examination Report dated Sep. 24, 2009 for European Publication No. 02 745 429.7-2208 (English Translation and Certificate of Translation dated Dec. 30, 2010).
J. Wünning: "Die Wärmebehandlung in der Fertigungslinie mit einem neuartigen Rollenherdofen," HTM Härterei—Technische Mitteilungen 45 Nov./Dec. 1990, No. 6, pp. 325-329 XP 163038.
Non-Final Office Acion dated Apr. 1, 2010 for U.S. Appl. No. 11/343,558.
Final Office Acion dated Oct. 15, 2010 for U.S. Appl. No. 11/343,558.
Non-Final Office Action dated Aug. 31, 2010 for U.S. Appl. No. 11/878,856.
Restriction Requirement dated Nov. 4, 2009 for U.S. Appl. No. 11/878,856.
Non-Final Office Action dated Mar. 22, 2010 for U.S. Appl. No. 11/878,856.
Restriction Requirement dated Apr. 26, 2010 for U.S. Appl. No. 12/486,528.
Non-Final Office Action dated Jul. 27, 2010 for U.S. Appl. No. 12/486,528.
Restriction Requirement dated Dec. 14, 2010 for U.S. Appl. No. 12/219,614.

* cited by examiner

SOFT MAGNETIC IRON/COBALT/CHROMIUM-BASED ALLOY AND PROCESS FOR MANUFACTURING IT

This application claims benefit of the filing date of U.S. Provisional Application Ser. No. 60/935,146, filed Jul. 27, 2007, the entire contents of which are incorporated herein by reference.

BACKGROUND

1. Field

Disclosed herein are soft magnetic iron/cobalt/chromium-based alloys and processes for manufacturing semi-finished products from these alloys, in particular magnetic components for actuator systems.

2. Description of Related Art

Certain soft magnetic iron/cobalt/chromium-based alloys are disclosed in DE 44 42 420 A1, for example. Such alloys can have high saturation magnetisation and can therefore be used to develop electromagnetic actuator systems with high forces and/or small dimensions. A typical use of these alloys is as cores for solenoid valves, such as for example solenoid valves for fuel injection in internal combustion engines, or as armatures in electrical motors.

Material machinability is an important factor in the manufacture of parts to be used as soft magnetic parts for actuators. It has been shown that iron/cobalt/chromium-based alloys present high levels of wear when subjected to chip-removing machining processes. This can be shown by the quality of the machined surface. In certain applications better surface quality is desirable.

Improving the machinability of iron-based alloys through the addition by alloying of elements such as Mn, S and Pb is already known. However, these elements can present the disadvantage that, as described in "Soft Magnetic Materials II Influence of Sulfur on Initial Permeability of Commercial 49% Ni—Fe alloys", D. A. Coiling et al, J. Appl. Phys. 40 (1969) 1571, for example, they can reduce the magnetic properties of soft magnetic alloys.

SUMMARY

One object of the invention disclosed herein is therefore to provide an iron/cobalt/chromium-based alloy which has improved machinability and good soft magnetic properties.

This object is achieved in the invention by means of the subject matter disclosed herein.

In one embodiment, the invention relates to a soft magnetic alloy consists essentially of 5 percent by weight≦Co≦30 percent by weight, 1 percent by weight≦Cr≦20 percent by weight, 0.1 percent by weight≦Al≦2 percent by weight, 0 percent by weight≦Si≦1.5 percent by weight, 0.017 percent by weight≦Mn≦0.2 percent by weight, 0.01 percent by weight≦S≦0.05 percent by weight where Mn/S>1.7, 0 percent by weight≦O≦0.0015 percent by weight, and 0.0003 percent by weight≦Ce≦0.05 percent by weight, 0 percent by weight≦Ca≦0.005 percent by weight where 0.117 percent by weight≦(Al+Si+Mn+V+Mo+W+Nb+Ti+Ni)≦5 percent by weight, and the remainder iron.

The alloy disclosed herein has a certain manganese and sulphur content. Without wishing to be bound by any theory, it is believed that these two elements give the alloy improved machinability. The alloy also has a certain cerium content. Again, without wishing to be bound by theory, it is believed that the combination of sulphur, manganese und cerium gives a soft magnetic alloy with better machinability than a sulphur-free alloy, whilst at the same time retaining soft magnetic properties, such as the magnetic properties of a sulphur-free alloy.

Another embodiment provides for a soft magnetic core for an electromagnetic actuator made of an alloy in accordance with one or more of the preceding embodiments. In various embodiments this soft magnetic core is a soft magnetic core for a solenoid valve of an internal combustion engine, a soft magnetic core for a fuel injection valve of an internal combustion engine and a soft magnetic core for a direct fuel injection valve of a spark ignition engine or a diesel engine.

Another embodiment provides for a soft magnetic armature for an electric motor which is also manufactured from an alloy as disclosed in one of the preceding embodiments. The various actuator systems such as solenoid valves and fuel injection valves have different requirements in terms of strength and magnetic properties. These requirements can be met by selecting an alloy with a composition which lies within the ranges described above.

Another embodiment provides for a fuel injection valve of an internal combustion engine with a component made of a soft magnetic alloy in accordance with one of the preceding embodiments. In further versions the fuel injection valve is a direct fuel injection valve of a spark ignition engine and a direct fuel injection valve of a diesel engine.

Another embodiment provides for a soft magnetic armature for an electric motor comprising an alloy in accordance with one of the preceding embodiments.

Another embodiment provides for a process for manufacturing semi-finished products from a cobalt/iron alloy in which workpieces are manufactured initially by melting and hot forming a soft magnetic alloy which consists essentially of 5 percent by weight≦Co≦30 percent by weight, 1 percent by weight≦Cr≦20 percent by weight, 0.1 percent by weight≦Al≦2 percent by weight, 0 percent by weight≦Si≦1.5 percent by weight, 0.017 percent by weight≦Mn≦0.2 percent by weight, 0.01 percent by weight≦S≦0.05 percent by weight where Mn/S is >1.7, 0 percent by weight≦O≦0.0015 percent by weight and 0.0003 percent by weight≦Ce≦0.05 percent by weight, 0 percent by weight≦Ca≦0.005 percent by weight where 0.117 percent by weight≦(Al+Si+Mn+V+Mo+W+Nb+Ti+Ni)≦5 percent by weight, and the remainder iron. A final annealing process can be carried out.

DETAILED DESCRIPTION OF SPECIFIC EMBODIMENTS

Figure 1:
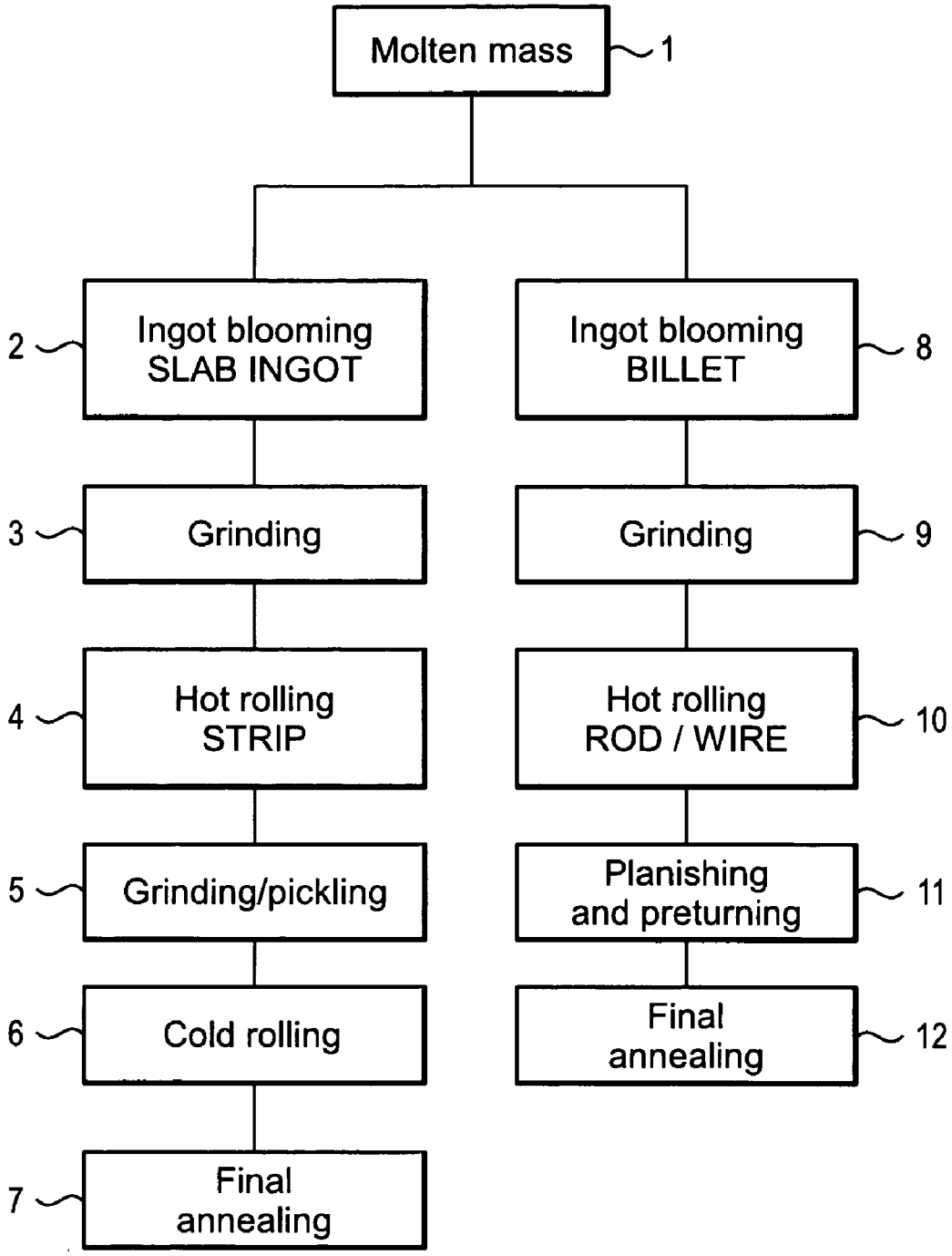
FIG. 1 shows a flow chart of one embodiment of a process for manufacturing a semi-finished product from an alloy according to the invention.

The term "essentially" indicates the inclusion of incidental impurities.

Sulphur is almost insoluble in iron. Iron sulphide forms a low-melting point eutectic (Ts=1188° C.) which settles on the grain boundaries and can lead to red shorting during hot rolling at 800° C. to 1000° C. Oxygen reduces the eutectic temperature even further. If manganese is also added from a ratio of Mn/S>1.7, corresponding to a ratio of 1:1 atom percent, all the sulphur is bound to the MnS which melts at 1600° C. MnS has a significantly higher melting point than FeS and after rolling is elongated and forms bands. Manganese sulphides have a lubricating effect on the cutting wedge and form imperfections in the steel which can lead to shorter chips. Without wishing to be bound by any theory, it is suggested that MnS precipitates have a similar function in the alloy disclosed in the invention since the machinability of the alloy is improved.

Microstructure analyses in combination with EDX analyses of the alloy disclosed in the invention demonstrate that it has finely distributed manganese sulphide precipitates. In alloys without the addition by alloying of cerium coarser manganese sulphide precipitates are shown.

Without wishing to be bound by any theory, it is suggested that the finer distribution of manganese sulphide precipitates does not lead to a deterioration in magnetic properties. One possible reason for this difference lies in the fact that the cerium content provides nuclei to which the manganese sulphide precipitates form, thereby leading to a finer distribution of the precipitates.

At the same time machinability is improved in comparison to a sulphur-free alloy. This can be shown by light-optical microscopy of the finish turned surface. Light-optical microscopy analysis of the alloys disclosed in the invention and sulphur-free comparative alloys show that the surface of the alloys disclosed in the invention is significantly more homogenous that that of an alloy with manganese sulphide precipitates which has no cerium.

In a particular embodiment, the alloy disclosed herein contains cerium but no calcium. In a second embodiment the alloy disclosed in the invention has cerium and calcium, wherein the amount of calcium, Ca is such that 0.001 percent by weight being $\leqq Ca \leqq 0.005$ percent by weight.

An alloy with a combination of Ce, Ca and S is also found to show soft magnetic properties corresponding to the soft magnetic properties of a comparable sulphur-free alloy, and improved machinability.

In a further particular embodiment the alloy has Ce and Ca, 0.001 percent by weight$\leqq Ca \leqq$0.005 percent by weight. In further embodiments, which can be either calcium-free or contain calcium, the maximum cerium content is reduced. In these embodiments 0.001 percent by weight$\leqq Ce \leqq$0.02 percent by weight or 0.001 percent by weight$\leqq Ce \leqq$0.005 percent by weight.

In other particular embodiments, the cobalt content, chromium content and/or manganese content is specified more particularly. The alloy may have a cobalt content of 8 percent by weight$\leqq Co \leqq$22 percent by weight, or 14 percent by weight$\leqq Co \leqq$20 percent by weight, and/or a chromium content of 1.5 percent by weight$\leqq Cr \leqq$3 percent by weight, or 6 percent by weight$\leqq Cr \leqq$15 percent by weight.

Alloys with the aforementioned compositions have a specific electrical resistance of $\rho$>0.40 $\mu\Omega$m or $\rho$>0.60 $\mu\Omega$m. This value provides an alloy which leads to lower eddy currents when used as a magnet core in an actuator system. This permits the use of the alloy in actuator systems with faster switching times.

In a particular embodiment, the apparent yielding point is $R_{p0.2}$>280 MPa. This greater alloy strength can lengthen the service life of the alloy when used as the magnet core in an actuator system. This is attractive when the alloy is used in high frequency actuator systems such as fuel injection valves in internal combustion engines.

The alloy disclosed herein has good soft magnetic properties, good strength and a high specific electrical resistance. In further embodiments the alloy has a coercive field strength of $H_c$<5.0 A/cm or $H_c$<2.0 A/cm and/or a maximum permeability $\mu_{max}$ of >1000. This combination of high specific resistance, low coercive field strength and good machinability is particularly advantageous in soft magnetic parts of an actuator system or an electric motor.

This alloy can be melted by means of various different processes. All current techniques including air melting and Vacuum Induction Melting (VIM), for example, are possible in theory. In addition, an arc furnace or inductive techniques may also be used. Treatment by Vacuum Oxygen Decarburization (VOD) or Argon Oxygen Decarburization (AOD) or Electro Slag Remelting (ESR) improves the quality of the product.

The VIM process is the preferred process for manufacturing the alloy since using this process it is on one hand possible to set the contents of the alloy elements more precisely and on the other easier to avoid non-metallic inclusions in the solidified alloy.

Depending on the semi-finished products to be manufactured, the melting process is followed by a range of different process steps.

If strips are to be manufactured for subsequent pressing into parts, the ingot produced in the melting process is formed by blooming into a slab ingot. Blooming refers to the forming of the ingot into a slab ingot with a rectangular cross section by a hot rolling process at a temperature of 1250° C., for example. After blooming, any scale formed on the surface of the slab ingot is removed by grinding. Grinding is followed by a further hot rolling process by means of which the slab ingot is formed into a strip at a temperature of 1250° C., for example. Any impurities which have formed on the surface of the strip during hot rolling are then removed by grinding or pickling, and the strip is formed to its final thickness which may be within a range of 0.1 mm to 0.2 mm by cold rolling. Ultimately, the strip is subjected to a final annealing process. During this final annealing any lattice imperfections produced during the various forming processes are removed and crystal grains are formed in the structure.

The manufacturing process for producing turned parts is similar. Here, too, the ingot is bloomed to produce billets of quadratic cross-section. On this occasion, the so-called blooming process takes place at a temperature of 1250° C., for example. The scale produced during blooming is then removed by grinding. This is followed by a further hot rolling process in which the billets are formed into rods or wires with a diameter of up to 13 mm, for example. Faults in the material are then corrected and any impurities formed on the surface during the hot rolling process removed by planishing and pre-turning. In this case, too, the material is then subjected to a final annealing process.

The final annealing process can be carried out within a temperature range of 700° C. to 1100° C. In one embodiment, final annealing is carried out within a temperature range of 750° C. to 850° C. The final annealing process may be carried out in inert gas, in hydrogen or in a vacuum.

In a further particular embodiment the alloy is cold formed prior to final annealing.

The invention is explained in greater detail with reference to the drawings, which are intended as an aid in understanding the invention, and are not intended to limit the scope of the invention or of the appended claims.

Table 1 shows the compositions of two alloys as disclosed in the invention and two comparison alloys.

Table 2 shows properties of the alloys designated 1 and 2 in Table 1.

Table 3 shows electrical and magnetic properties of the alloys designated 3 and 4 in Table 1.

Table 4 shows strength properties of the alloys designated 3 and 4 in Table 1.

TABLE 1

| Alloy | Fe | Co (wt %) | Cr (wt %) | Mn (wt %) | Si (wt %) | Al (wt %) | O (wt %) | S (wt %) | Ce (wt %) | Ca (ppm) |
|---|---|---|---|---|---|---|---|---|---|---|
| 1* | Remainder | 16.45 | 2.06 | 0.05 | 0.49 | 0.19 | 0.0010 | <0.003 | 0.002 | 0 |
| 2 | Remainder | 16.45 | 2.05 | 0.05 | 0.44 | 0.17 | 0.0012 | 0.028 | 0.05 | 2 |
| 3* | Remainder | 9.20 | 13.10 | 0 | 0 | 0.26 | | 0 | 0 | 0 |
| 4 | Remainder | 9.25 | 13.20 | 0.08 | 0 | 0.27 | | 0.043 | 0.01 | 0 |

*indicates a comparative alloy not part of the invention

TABLE 2

| Alloy | $\rho_{el}$ (μΩm) | $H_c$ (A/cm) | J(160) (T) | J(400) (T) | $\mu_{max}$ | $R_{p0.2}$ (Mpa) | $A_L$ (%) |
|---|---|---|---|---|---|---|---|
| 1* | 0.430 | 0.90 | 2.00 | 2.19 | 4016 | 233 | 22.7 |
| 2 | 0.422 | 1.18 | 2.03 | 2.18 | 4376 | 296 | 22.4 |

*indicates a comparative alloy not part of the invention

TABLE 3

| | | J at H (A/cm) in T | | | | | |
|---|---|---|---|---|---|---|---|
| Alloy | $H_c$ (A/cm) | 100 A/cm | 160 A/cm | 200 A/cm | 400 A/cm | ρ (μΩm) | $\mu_{max}$ |
| 3* | 1.4 | 1.68 | 1.76 | 1.79 | 1.82 | 0.6377 | 4066 |
| 4 | 1.7 | 1.68 | 1.75 | 1.78 | 1.81 | 0.6409 | 2955 |

*indicates a comparative alloy not part of the invention

TABLE 4

| Alloy | $R_{p0.1}$ (MPa) | $R_{p0.2}$ (MPa) | $R_m$ (MPa) | $A_L$ (%) | HV | Z (%) | E modulus (GPa) |
|---|---|---|---|---|---|---|---|
| 3* | 290 | 298 | 493 | 18.84 | 151 | 83.08 | 132 |
| 4 | 333 | 341 | 561 | 19.3 | 164 | 79.94 | 148 |

*indicates a comparative alloy not part of the invention

The compositions of two alloys as disclosed in the invention and two comparison alloys are summarised in Table 1.

Alloy (1) is a comparison alloy which does not contain, or contains only very small amounts of, sulphur. However, alloy (1) does contain Ce and consists of 16.45 percent by weight Co, 2.06 percent by weight Cr, 0.05 percent by weight Mn, 0.49 percent by weight Si, 0.19 percent by weight Al, 0.0010 percent by weight O, less than 0.003 percent by weight S, 0.002 percent by weight Ce and the remainder iron.

Alloy (2) is disclosed in the invention and thus contains sulphur, S, cerium, Ce, and Calcium, Ca. The composition of alloy (2) is 16.45 percent by weight Co, 2.05 percent by weight Cr, 0.05 percent by weight Mn, 0.44 percent by weight Si, 0.17 percent by weight Al, 0.0012 percent by weight O, 0.028 percent by weight S, 0.05 percent by weight Ce, 2 ppm Ca and the remainder iron.

The properties of specific electrical resistance $\rho_{el}$, coercive field strength $H_c$, saturation J at a magnetic field strength of 160 A/cm, J(160 A/cm), saturation J at a magnetic field strength of 400 A/cm, J(400 A/cm), maximum permeability $\mu_{max}$, apparent yielding point $R_{p0.2}$ and elongation at rupture $A_L$ of alloys (1 and 2) are summarised in Table 2.

Comparison alloy (1) has a specific electrical resistance $\rho_{el}$ of 0.430 μΩm, a coercive field strength $H_c$ of 0.90 A/cm, a saturation J at a magnetic field strength of 160 A/cm, J(160 A/cm), of 2.00 T, a saturation J at a magnetic field strength of 400 A/cm, J(400 A/cm), of 2.19 T, a maximum permeability $\mu_{max}$ of 4016, an apparent yielding point $R_{p0.2}$ of 233 MPa and an elongation at rupture $A_L$ of 22.7%.

Alloy (2) as disclosed in the invention has a specific electrical resistance $\rho_{el}$ of 0.422 μΩm, a coercive field strength $H_c$ of 1.18 A/cm, a saturation J at a magnetic field strength of 160 A/cm, J(160 A/cm), of 2.03 T, a saturation J at a magnetic field strength of 400 A/cm, J(400 A/cm), of 2.18 T, a maximum permeability $\mu_{max}$ of 4376, an apparent yielding point $R_{p0.2}$ of 296 MPa and an elongation at rupture $A_L$ of 22.4%.

A comparison of these values shows that alloy (2) as disclosed in the invention and which contains sulphur, cerium and calcium has similar soft magnetic properties to the sulphur-free comparison alloy (1). Consequently, the sulphur content does not lead to a reduction in soft magnetic properties as is the case in the iron-based alloys representing the prior art.

The machinability of these alloys was examined using scanning electron microscopy and light-optical microscopy. Alloy (2) as disclosed in the invention shows significantly less wear during machining. Similarly, the quality of the surface of alloy (2) as disclosed in the invention is improved.

Alloy (2) was also examined using Energy Dispersive X-Ray (EDX) analysis. This examination shows that alloy (2) has finely distributed manganese sulphide precipitates. These examinations also show that cerium is located in the core of these precipitates. Thus, without wishing to be bound by any theory, it is also suggested that the fine distribution of the manganese sulphides precipitates is achieved through the addition by alloying of cerium. It is also suggested that this fine distribution of manganese sulphide precipitates is responsible for the improved machinability but not for reducing its magnetic properties.

Table 1 summarises the composition of two further alloys (3 and 4). In comparison to alloys (1 and 2), alloys (3 and 4) have less Co and a greater Cr content and a greater Al content.

Alloy (3) is a comparison alloy which does not contain sulphur. Alloy (3) consists of 9.20 percent by weight Co, 13.10 percent by weight Cr, 0.26 percent by weight Al and the remainder iron.

Alloy (4) is disclosed in the invention and thus contains S and Ce. The composition of alloy (4) is 9.25 percent by weight Co, 13.20 percent by weight Cr, 0.08 percent by weight Mn, 0.27 percent by weight Al, 0.043 percent by weight S, 0.01 percent by weight Ce and the remainder iron.

In comparison to alloy (2) as disclosed in the invention, alloy (4) has a higher S content and a higher Ce content, but contains no Ca.

Electrical and magnetic properties of alloys (3 and 4) are summarised in Table 3.

Comparison alloy (3) has a specific electrical resistance $\rho_{el}$ of 0.6377 μΩm, a coercive field strength $H_c$ of 1.4 A/cm, a saturation J at a magnetic field strength of 100 A/cm, J(100 A/cm), of 1.68 T, a saturation J at a magnetic field strength of 160 A/cm, J(160 A/cm), of 1.76 T, a saturation J at a magnetic field strength of 200 A/cm, J(200 A/cm), of 1.79 T, a saturation J at a magnetic field strength of 400 A/cm, J(400 A/cm), of 1.82 T and a maximum permeability $\mu_{max}$ of 4066.

Alloy (4) as disclosed in the invention has a specific electrical resistance $\rho_{el}$ of 0.6409 μm, a coercive field strength $H_c$ of 1.7 A/cm, a saturation J at a magnetic field strength 100 A/cm, J(100 A/cm), of 1.68 T, a saturation J at a magnetic field strength of 160 A/cm, J(160 A/cm), of 1.75 T, a saturation J at a magnetic field strength of 200 A/cm, J(200 A/cm), of 1.78 T, a saturation J at a magnetic field strength of 400 A/cm, J(400 A/cm), of 1.81 T and a maximum permeability $\mu_{max}$ of 2955.

As in alloys (1 and 2), a comparison of these values for alloys (3 and 4) shows that alloy (4) as disclosed in the invention and which contains sulphur and cerium has similar soft magnetic properties to the sulphur-free comparison alloy (3). In this basic composition the sulphur content once again does not lead to a reduction in soft magnetic properties as is the case in the iron-based alloy representing the prior art.

The strength properties of alloys (3 and 4) are summarised in Table 4.

Comparison alloy (3) has a tensile strength $R_m$ of 493 MPa, an apparent yielding point $R_{p0.1}$ of 290 MPa and $R_{p0.2}$ of 298 MPa, an elongation at rupture $A_L$ of 18.84%, a pyramid hardness HV of 151, a constriction Z of 83.08% and a modulus of elasticity of 132 GPa.

Alloy (4) as disclosed in the invention has a tensile strength $R_m$ of 561 MPa, an apparent yielding point $R_{p0.1}$ of 333 MPa and $R_{p0.2}$ of 341 MPa, an elongation at rupture $A_L$ of 19.30%, a pyramid hardness HV of 164, a constriction Z of 79.94% and a modulus of elasticity of 148 GPa.

A comparison of these values shows that the alloy with MnS precipitates disclosed in the invention has better mechanical properties than the sulphur-free comparison alloy (3). Semi-finished products are manufactured from this alloy as disclosed in the invention by means of a process illustrated in the flow diagram shown in FIG. 1.

In the flow chart illustrated in FIG. 1 the alloy is first melted in a melting process (1).

This alloy can be melted by means of various different processes. All current techniques including air melting and Vacuum Induction Melting (VIM), for example, are possible in theory. In addition, an arc furnace or inductive techniques may also be used. Treatment by Vacuum Oxygen Decarburization (VOD) or Argon Oxygen Decarburization (AOD) or Electro Slag Remelting (ESR) improves the quality of the product.

The VIM process is the preferred process for manufacturing the alloy since using this process it is on one hand possible to set the contents of the alloy elements more precisely and on the other easier to avoid non-metallic inclusions in the solidified alloy.

Depending on the semi-finished products to be manufactured, the melting process can be followed by a range of different process steps.

If strips are to be manufactured for subsequent pressing into parts, the ingot produced in the melting process (1) is formed by blooming (2) into a slab ingot. Blooming refers to the forming of the ingot into a slab ingot with a rectangular cross section by a hot rolling process at a temperature of 1250° C., for example. After blooming, any scale formed on the surface of the slab ingot is removed by grinding (3). Grinding (3) is followed by a further hot rolling process (4) by means of which the slab ingot is formed into a strip with a thickness of 3.5 mm, for example, at a temperature of 1250° C. Any impurities which have formed on the surface of the strip during hot rolling are then removed by grinding or pickling (5), and the strip is formed to its final thickness which can be within a range of 0.1 mm to 0.2 mm by cold rolling (6). Ultimately, the strip is subjected to a final annealing process (7) at a temperature of 850° C. During this final annealing, any lattice imperfections produced during the various forming processes are removed and crystal grains are formed in the structure.

The manufacturing process for producing turned parts is similar. Here, too, the ingot is bloomed (8) to produce billets of quadratic cross-section. On this occasion, the so-called blooming process takes place at a temperature of 1250° C., for example. The scale produced during blooming (8) is then removed by grinding (9). This is followed by a further hot rolling process (10) in which the billets are formed into rods or wires with a diameter of up to 13 mm, for example. Faults in the material are then corrected and any impurities formed on the surface during the hot rolling process removed by planishing and pre-turning. In this case, too, the material is then subjected to a final annealing process.

Figure 2:
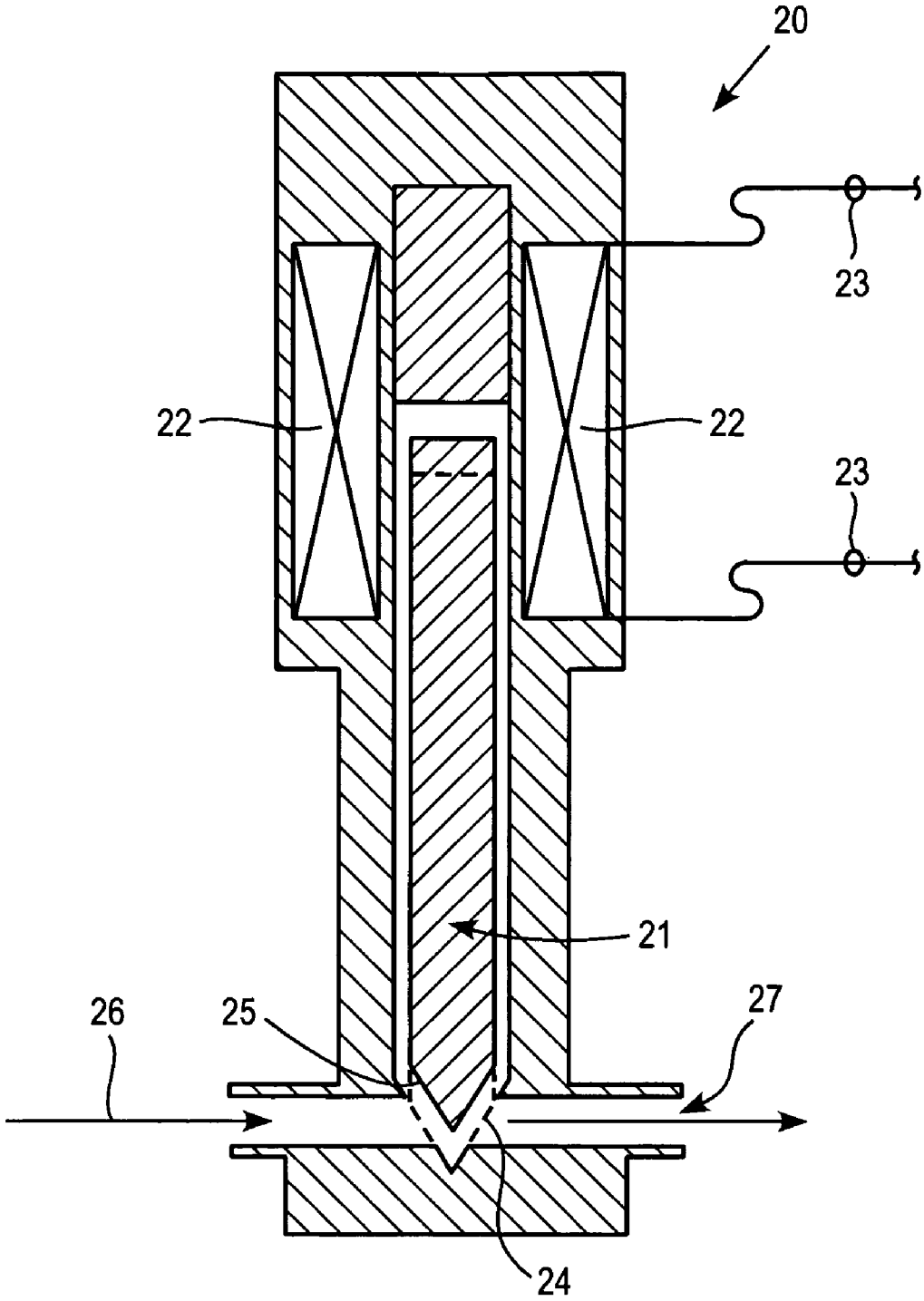
FIG. 2 is a schematic diagram showing an embodiment of a solenoid valve with a magnet core made of an embodiment of a soft magnetic alloy according to the invention.

FIG. 2 shows an electromagnetic actuator system (20) with a magnet core (21) made of a soft magnetic alloy as disclosed in the invention which, in a first embodiment, consists essentially of 16.45 percent by weight Co, 2.05 percent by weight Cr, 0.05 percent by weight Mn, 0.44 percent by weight Si, 0.17 percent by weight Al, 0.0012 percent by weight O, 0.028 percent by weight S, 0.05 percent by weight Ce, 2 ppm Ca and the remainder iron.

In a second embodiment the soft magnetic alloy of the magnetic core (21) consists essentially of 9.25 percent by weight Co, 13.20 percent by weight Cr, 0.08 percent by weight Mn, 0.27 percent by weight Al, 0.043 percent by weight S, 0.01 percent by weight Ce and the remainder iron. Other alloys within the scope of the disclosure herein can be used to form the magnetic core (21).

A coil (22) is supplied with current from a current source (23) such that when the coil (22) is excited a magnetic field is induced. The coil (22) is positioned around the magnet core (21) in such a manner that the magnet core (21) moves from a first position (24) illustrated by the broken line in FIG. 2 to a second position (25) due to the induced magnetic field. In this embodiment the first position (24) is a closed position and the second position is an open position. Consequently the current (26) is controlled through the channel (27) by the actuator system (20). It will be understood that in other embodiments, the first position may be an open position and the second position may be a closed position.

In further embodiments the actuator system (20) is a fuel injection valve of a spark ignition engine or a diesel engine or a direct fuel injection valve of a spark ignition engine or a diesel engine. Such an actuator system can be produced according to the disclosure provided above.

The invention having been described by reference to certain of its specific embodiments, it will be recognized that departures from these embodiments can be made within the spirit and scope of the invention, and that these specific embodiments are not limiting of the appended claims.

What is claimed is:

1. A soft magnetic alloy consisting essentially of:

an amount of cobalt Co, such that 5 percent by weight≦Co≦30 percent by weight, an amount of chromium Cr, such that 1 percent by weight≦Cr≦20 percent by weight, an amount of aluminum Al, such that 0.1 percent by weight≦Al≦2 percent by weight, optionally, an amount of silicon Si, such that 0 percent by weight≦Si≦1.5 percent by weight, an amount of manganese Mn, such that 0.017 percent by weight≦Mn≦0.2 percent by weight, an amount of sulfur S, such that 0.01 percent by weight≦S≦0.05 percent by weight, and wherein where Mn/S>1.7, optionally, an amount of oxygen O, such that 0 percent by weight≦O≦0.0015 percent by weight, an amount of cerium Ce, such that 0.001 percent by weight≦Ce≦0.05 percent by weight, optionally, an amount of calcium Ca, such that 0 percent by weight≦Ce≦0.005 percent by weight, optionally, amounts of vanadium V, molybdenum Mo, tungsten W, niobium Nb, titanium Ti, and nickel Ni, such that the amounts of Al, Si, and Mn, and any amounts of V, Mo, W, Nb, Ti, and Ni present are such that 0.117 percent by weight≦(Al+Si+Mn+V+Mo+W+Nb+Ti+Ni)≦5 percent by weight, and the remainder iron, wherein the alloy has a coercive field strength $H_c$<5.0 A/cm.

2. The soft magnetic alloy in accordance with claim 1, wherein 0.001 percent by weight≦Ca≦0.005 percent by weight.

3. The soft magnetic alloy in accordance with claim 1, wherein 0.001 percent by weight≦Ce≦0.02 percent by weight.

4. The soft magnetic alloy in accordance with claim 3, wherein 0.001 percent by weight≦Ce≦0.005 percent by weight.

5. The soft magnetic alloy in accordance with claim 1, wherein 8 percent by weight≦Co≦22 percent by weight.

6. The soft magnetic alloy in accordance with claim 5, wherein 14 percent by weight≦Co≦20 percent by weight.

7. The soft magnetic alloy in accordance with claim 1, wherein 1.5 percent by weight≦Cr≦3 percent by weight.

8. The soft magnetic alloy in accordance with claim 5, wherein 6 percent by weight≦Cr≦15 percent by weight.

9. The soft magnetic alloy in accordance with claim 1, wherein the alloy has a specific electrical resistance $\rho_{el}$>0.40 μΩm.

10. The soft magnetic alloy in accordance with claim 9, wherein the alloy has a specific electrical resistance $\rho_{el}$>0.60 μΩm.

11. The soft magnetic alloy in accordance with claim 1, wherein the alloy has an apparent yielding point $R_{p0.2}$>280 MPa.

12. The soft magnetic alloy in accordance with claim 1, wherein the alloy has a coercive field strength $H_c$<2.0 A/cm.

13. The soft magnetic alloy in accordance with claim 1, wherein the alloy has a maximum permeability $\mu_{max}$>1000.

14. A soft magnetic core for an electromagnetic actuator comprising an alloy in accordance with claim 1.

15. A soft magnetic core for a solenoid valve of an internal combustion engine comprising an alloy in accordance with claim 1.

16. A soft magnetic core for a fuel injection valve of an internal combustion engine comprising an alloy in accordance with claim 1.

17. A soft magnetic core for a direct fuel injection valve of a spark ignition engine comprising an alloy in accordance with claim 1.

18. A soft magnetic core for a direct fuel injection valve of a diesel engine comprising an alloy in accordance with claim 1.

19. A fuel injection valve of an internal combustion engine comprising a component comprising a soft magnetic alloy in accordance with claim 1.

20. The fuel injection valve in accordance with claim 19, wherein the fuel injection valve is a direct fuel injection valve of a spark ignition engine.

21. The fuel injection valve in accordance with claim 19, wherein the fuel injection valve is a direct fuel injection valve of a diesel engine.

22. A soft magnetic armature for an electric motor comprising an alloy in accordance with claim 1.

23. A process for manufacturing semi-finished products made of a cobalt/iron alloy in which workpieces are manufactured by:

melting and hot forming a soft magnetic alloy in accordance with claim 1, and carrying out a final annealing process on said alloy.

24. The process in accordance with claim 23, wherein the final annealing is carried out within a temperature range of 700° C. to 1100° C.

25. The process in accordance with claim 24, wherein the final annealing is carried out within a temperature range of 750° C. to 850° C.

26. The process in accordance with claim 23, further comprising cold forming the alloy prior to final annealing.

27. The process in accordance with claim 23, wherein the final annealing process comprises subjecting the alloy to an inert gas, hydrogen or a vacuum.

* * * * *